US006903296B2

(12) United States Patent
Gomez

(10) Patent No.: US 6,903,296 B2
(45) Date of Patent: Jun. 7, 2005

(54) METHOD OF MAKING A METALLIC COMPONENT

(75) Inventor: Rafael Garcia Gomez, Paderborn (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 13 days.

(21) Appl. No.: 10/395,716

(22) Filed: Mar. 24, 2003

(65) Prior Publication Data

US 2003/0189027 A1 Oct. 9, 2003

(30) Foreign Application Priority Data

Mar. 22, 2002 (DE) ..... 102 12 819

(51) Int. Cl.[7] ..... C21D 1/04
(52) U.S. Cl. ..... 219/50; 148/566; 219/156
(58) Field of Search ..... 219/50, 156; 148/224, 148/566

(56) References Cited

U.S. PATENT DOCUMENTS 531,197 A * 12/1894 Lemp ..... 148/566
1,533,236 A * 4/1925 Dawson ..... 148/566
1,979,111 A * 10/1934 Kalschne ..... 219/50
1,985,805 A * 12/1934 Spire ..... 219/50
2,017,305 A * 10/1935 Campbell ..... 148/566
2,086,801 A * 7/1937 Hayden ..... 148/566
2,972,043 A * 2/1961 Stich ..... 219/156
3,855,013 A * 12/1974 Prohaszka et al. ..... 148/566
5,916,389 A * 6/1999 Lundstrom ..... 148/640

FOREIGN PATENT DOCUMENTS

| | | |
|---|---|---|
| DE | 197 23 655 | 12/1997 |
| DE | 200 14 361 | 11/2000 |
| JP | 08049014 | 2/1996 |

* cited by examiner

*Primary Examiner*—Clifford C. Shaw
(74) *Attorney, Agent, or Firm*—Herbert Dubno

(57) ABSTRACT

A metallic component is made by heating with subsequent hardening by rapid cooling. In the component unhardened regions remain, in that the component is electrically resistant heated and defined regions, either by partial resistance heating of the other regions, by overbridging or by cooling are excluded from heating above the austenitization temperature so that after a subsequent hardening process, they will remain with a ductile structure.

9 Claims, 4 Drawing Sheets

METHOD OF MAKING A METALLIC COMPONENT

FIELD OF THE INVENTION

The invention relates to a method of making a metallic component by heating and subsequently hardening through rapid cooling whereby unhardened regions remain in the component.

BACKGROUND OF THE INVENTION

It is known to produce tool-hardened shaped structural parts for motor vehicle components, for example drive components like steering rods or cross bars, or structural components like door impact beams, B-columns, struts or shock absorbers which have material properties which are distributed uniformly over the shaped bodies. This is done by completely hardening the shaped body which can be in conjunction with an annealing or optionally a tempering process. These parts should have, on the one hand, a high strength so that they remain stable in, for example, a crash. On the other hand these parts should also be deformable in a crash so that the crash energy can be absorbed as deformation energy. In various applications in motor vehicle technology, shaped components should have a high strength over certain regions and other regions with a high ductility. For example, in the case of a B-column, the column foot should be relatively ductile, while high strength properties should be established on the upper part of the column.

Aside from reinforcement with additional plates or by joining together parts of different strength, it is already known to so treat a structural component by heat treatment that it has local regions of higher strength or higher ductility.

Thus DE 197 43 802 C2 describes a process for producing a shaped article for motor vehicle components with regions of different ductility and with a starting billet, before or after pressing is only partially heated or starting from a prior homogeneous heating is after heated in a targeted manner in the regions at which higher ductility is desired. The after-heating for producing ductile regions has however the drawback that the shaped body can distort.

DE 197 23 655 A1 describes a process for the partial hardening of a shaped body whereby a starting billet is homogeneously heated in a furnace and then hardened in a cooled pair of tools, whereby partial regions of the workpiece have hardening inhibited by slower cooling in that at these regions in the tool, recesses or thermally insulating inserts are disposed or in these regions in the tool the induction heating is applied. The purpose of this process is to provide nonhardened regions in the shaped body at which, additional machining, for example, drilling can be carried out. The method of DE 197 23 615 A1 is problematical in the context of a hot-forming process since at the locations of the recesses in the tool, shaping cannot occur and with larger ductile regions, thermally insulating inserts are provided in the tool which limit the hardening and interfere with the shaping process so that breakage is possible. The inductive hardening is possible only with finish-shaped parts and requires certain intrinsic operating steps. As a consequence the subsequent inductive hardening is expensive and has the danger of resulting in distortion.

European Patent EP 0 816 520 B1 describes a shaped article and a method for providing desired strength and hardening patterns over its length, whereby the shaped body, after its shaping, is inductively heated and then quenched to produce the hardened regions.

DE 200 14 361 U1 describes a B-column which also has regions of different strengths. The formation of the B-column is effected in a hot-forming process whereby starting from a blank or a preformed longitudinal profile, the workpiece is austenitized in a furnace and then shaped and hardened in a cooled tool. In the furnace large-area regions of the workpiece are insulated against the effect of the temperature whereby in these regions the austenitization temperature is not reached and as a consequence during the hardening no martensitic structure arises in the hardening and shaping tool.

Alternatively it has been proposed to initially completely austenitize the longitudinal section and in the transport in the hardening tool to limit the cooling in a targeted manner in a region so that it is not excessively rapid, for example by blowing on it to bring it to a temperature clearly below the austenitization temperature. In the hardening tool there may thus no purely martensitic structure formation but rather the formation of a mixed structure with clear ferrite/bainite components which has ductile properties.

This method has, when utilized practically in mass production, a number of problems. The insulation by encapsulation in a furnace is technologically expensive because in each cycle each individual part requires its own insulation, the application of the insulation must involve a previous preparation step for the heating process-and prolongs the latter and the insulation must be heated up in the case of repeated use. This makes the mass production system cost intensive. A targeted cooling down, which is not too precipitous for a limited region to a temperature significantly below the austenitization temperature during the transport process, is difficult to control because of the cooling conditions in mass production which makes it difficult to provide a corresponding temperature control for each product to be made.

OBJECT OF THE INVENTION

The present invention thus has as its object to provide a method of producing a metallic component with at least two different structured regions which is so improved that it is suitable for mass production.

SUMMARY OF THE INVENTION

This object is achieved, according to the invention, in that a metallic component, which for example can be a slab or a preformed component of steel or light metal, an extrusion-pressed section of light metal or a forged blank, can be heated by means of electrical resistant heating and during the resistance heating cooled in targeted regions or electrically or thermally bridged so that these regions remain below the austenitization temperature. The advantage of the method according to the invention is that with this process components can be processed in a compact apparatus at a high cycling rate. The electrical resistance heating can be carried out in a workplace which occupies relatively little space by comparison to a continuous furnace. More specifically, a component can be completely heated in seconds to the austenitization temperature. The regions which after hardening are to have a ductile structure can be brought to a reduced temperature in a targeted manner by cooling or bridging.

As an alternative thereto, the component can be heated by electric resistance heating and during or prior to the resistance heating, brought to a temperature above the austenitization temperature in a targeted manner only in certain regions. In this case the treatment involves a partial heating.

In a special embodiment of the first aspect of the process described, the component, in those regions which are to have a ductile structure, is treated in a targeted manner with cooling bodies, cooling liquid or cooling gases locally. As a result in these regions during the electric resistant heating, a temperature level below the austenitization temperature is established so that during a subsequent hardening process in these regions no martensite is formed.

Similarly advantageously, during the resistance heating by electrical bridging of the regions of the component which are to have ductile structures utilizing electrodes with particular electrode patterns, for example through electrical conductors or plate electrodes which are connected together across these regions, the temperature can be held below the austenitization temperature in these selected regions. Preferably, however, for the electrical bridging of regions of the component a solid body is applied which has a higher electrical conductivity than the component. This solid body can, for example, be a copper piece which has a defined geometry which provides the desired shape of the ductile region of the component composed for example of steel, which is to be obtained. Since copper conducts electric current as well as heat better than steel, the copper piece bridges the region which is to have ductile characteristics in the finished component both electrically in that the current flows through the copper instead of through the steel, as well as thermally, in that the copper piece carries away heat which develops. As a consequence the corresponding region is maintained cooler than the remaining component and as a result in subsequent hardening by rapid cooling, is excluded from the hardening.

The defined regions of the component which are to remain at a temperature below the austenitization temperature during the electrical resistance heating can be cooled especially in a targeted region in that the cooling liquids and/or cooling gases are applied to these regions by nozzles with accelerated flow. To avoid an energy loss in the regions of the component bordering on these defined regions and which may be excessive and which are to be brought by the electrical resistance heating to a temperature above the austenitization temperature, it can suffice that poorly electrically conducting solid structures can be applied as cooling bodies to the defined regions of the component which are to be held below the austenitization temperature. Thus, for example, during the electrical resistance heating of a component composed of steel, a solid body of ceramic can be applied to it. Ceramic conducts electric current only poorly and thus the electric current flows substantially completely through the steel component. The heating which is produced, however, in the region at which the ceramic body is found, is conducted away at last in part through the ceramic body. As a result, this region is held at a temperature below the austenitization temperature and simultaneously the remaining component is heated with the least possible energy loss to a temperature above the austenitization temperature so that one obtains after subsequent hardening a component with hardened and ductile regions. It can be sufficient to apply a metallic solid structure as the cooling body which has a lower electrical conductivity by comparison to that of the component.

It is especially advantageous for the method of the invention when the hardening is carried out in a hot forming tool.

With the method here described it is especially possible for an unhardened region of the component to be subjected to subsequent machining as, for example, by a drilling or cutting.

BRIEF DESCRIPTION OF THE DRAWING

The invention is described below in greater detail in several embodiments in conjunction with the accompanying drawing.

In the drawing.

SPECIFIC DESCRIPTION

Figure 1:
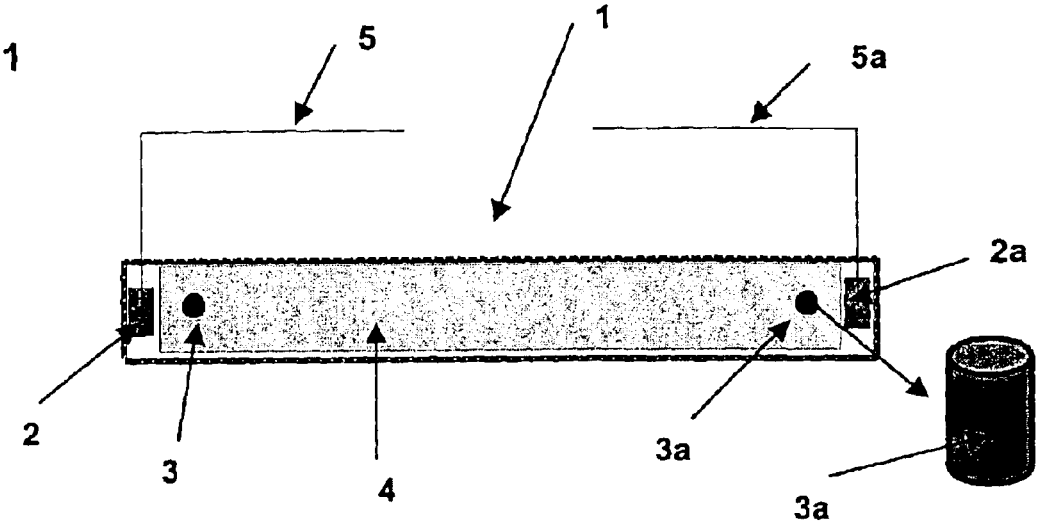
FIG. 1 is a schematic plan view of a slab or blank with constant cross sectional area over its length, two electrodes and two bridging elements.

FIG. 1 shows schematically in a plan view, a rectangular slab or blank 1 of steel on the outer ends of which respective electrodes 2, 2*a* are provided both on the upper side and on the lower side of the slab 1 for resistance heating thereof. Between these electrodes an electric current circuit 5, 5*a* is closed whereby the slab 1 can be resistance-heated electrically to seconds. The heating is shown by a grey pattern 4 (see FIG. 6). On the slab 1 there are found two bridge elements 3, 3*a* which, in these regions, prevent the heating of the slab 1 to the austenitization temperature. These bridge elements 3, 3*a* are electrically conductive solid bodies like, for example, copper cylinders.

Figure 2:
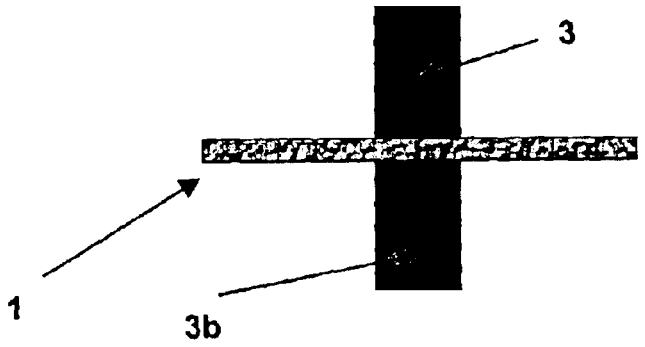
FIG. 2 is a detail in cross section in the longitudinal direction of current flow through the blank of FIG. 1 with one of two bridging elements which are electrically conductive and engage it from opposite sides, in an unheated state.

FIG. 2 shows in a detail a cross section in the longitudinal direction of electric current flow through the slab 1 of FIG. 1 in the region in which the electrically conductive solid bodies 3, 3*b* are found and formed by an upper 3 and a lower 3*b* solid body applied to the slab 1. FIG. 2 shows the slab 1 in the starting state before an electric resistance heating.

Figure 3:
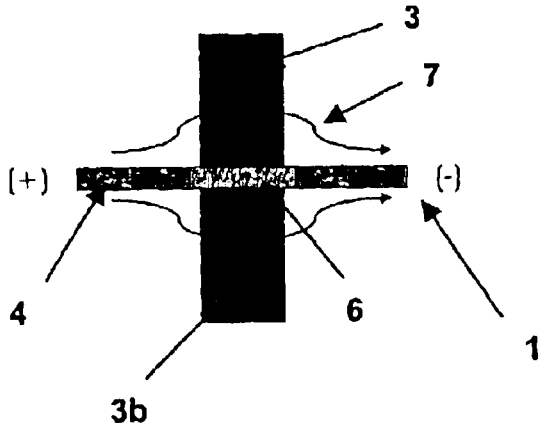
FIG. 3 is a detail of FIG. 2 during the electrical resistance heating.

In FIG. 3, a voltage 7 has been applied to the slab 1. As a result the electric current flows in the arrow direction 7 from the plus terminal through the slab 1 in the electrically conductive solid body 3, 3*b* as for example a copper cylinder and through the solid body 3, 3*b* again into the slab to the minus terminal. Thus the regions of the slab 1 to the left and right of the solid bodies 3, 3*b* are heated to the austenitization temperature 4 while in the region of the solid bodies 3, 3*b* both electric current and also the heat are conducted away in the solid body 3, 3*b*. As a result, the region of the slab 1 which is found between the two applied solid bodies 3, 3*b* is held below the austenitization temperature 6. After a subsequent hardening, unhardened regions 6 are therefore found in the slab 1. In FIG. 1 two bridging elements 3, 3*a* can be seen. FIG. 2 is a detail showing the unheated state of the system of FIG. 1 while FIG. 3 is a detail during the resistance heating.

Figure 4:
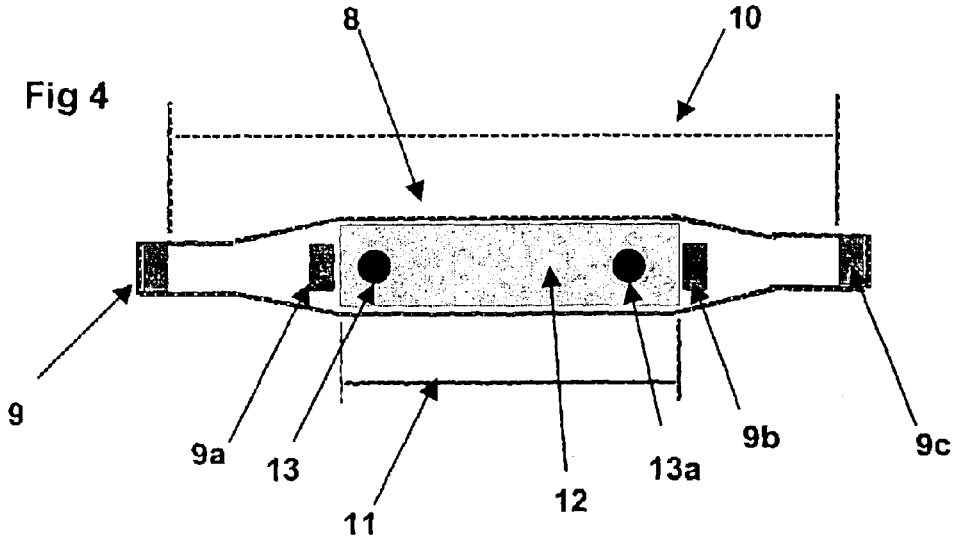
FIG. 4 is a schematic plan view of a blank with nonuniform cross section over its length with four electrodes, two cooling elements and a preheated region.

FIG. 4 shows schematically in plan view a slab 8 of nonuniform cross section which includes two smaller ends and a wider middle. At the respective ends of the slab and in the transition regions from smaller to larger cross section, there are respective electrodes 9, 9*a*, 9*b*, 9*c* both on the upper and on the lower side of the slab 8. Between the two inner electrodes 9, 9*b* an electric current circuit 11 is closed which heats a central region of the slab 8 of proportionately larger cross section to a preheating or final heating temperature 12. Should the respective ends of this slab 8 remain ductile, they are not heated together with the central portion in that between two outer electrodes 9, 9*c* no voltage is applied. It is however also possible, after a preheating of the central region, to bring the entire component to the austenitization temperature by means of a voltage 10 applied by means of the two outer electrodes 9, 9*c*. In any case, two regions of the slab 8 can be maintained below the austenitization temperature by the application of respective cooling elements 13, 13*a*.

Figure 5:
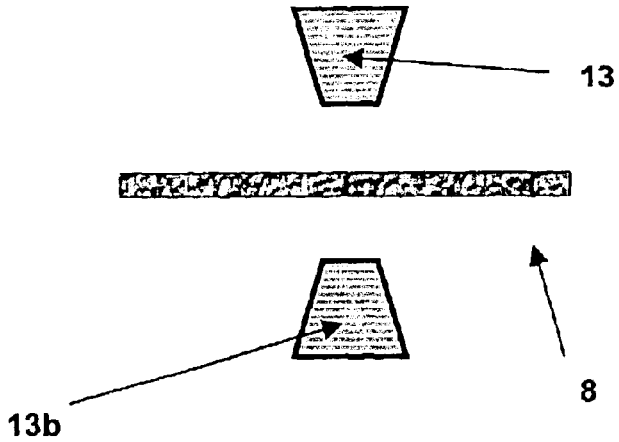
FIG. 5 is a detail of a cross section through the blank of FIG. 4 with a cooling element engageable from both sides, prior to an electrical resistance heating.

As has been illustrated in FIG. 5 in cross section the cooling elements 13, 13*b* can be nozzles from which cooling liquid like oil or cooling gas like for example air can be directed against the workpiece. FIG. 5 shows the workpiece in an unheated state with the nozzles cut off.

Figure 6:
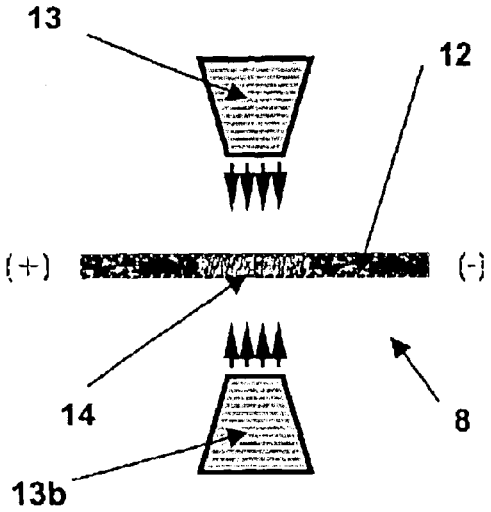
FIG. 6 is a detail of FIG. 5 during the electrical resistance heating.

In FIG. 6 a voltage is applied to the slab 8. The electric current flows therefore through the slab 8 and heats it. The slab is heated to or above the austenitization temperature to the left and right of the nozzles 13, 13*b* which are switched on. There, where the nozzles 13, 13*b* directed a cooling medium onto the slab 8 in the direction of the arrows, an electric current flows through the slab, the heating temperature 14 remains however below the austenitization temperature. After a subsequent hardening, this cooled region 14 of the slab 8 remains in a more ductile state than the remainder of the slab 8.

Figure 7:
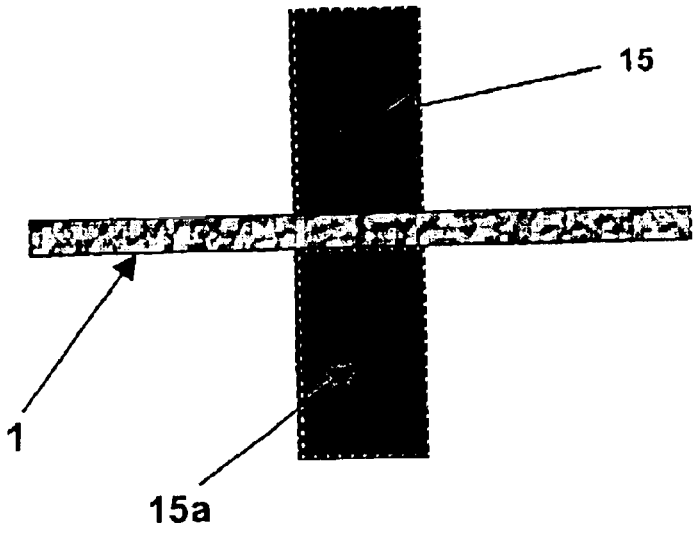
FIG. 7 is a schematic cross section in the longitudinal direction of current flow through a blank with two bridging elements which are poorly electrically conducting, prior to the resistance heating.

FIG. 7 shows schematically in section a blank 1 with a poorly electrically conducting solid body 15, 15*a* on each of two sides, like for example, a ceramic cylinder. In FIG. 7, no electric resistance heating has as yet taken place.

Figure 8:
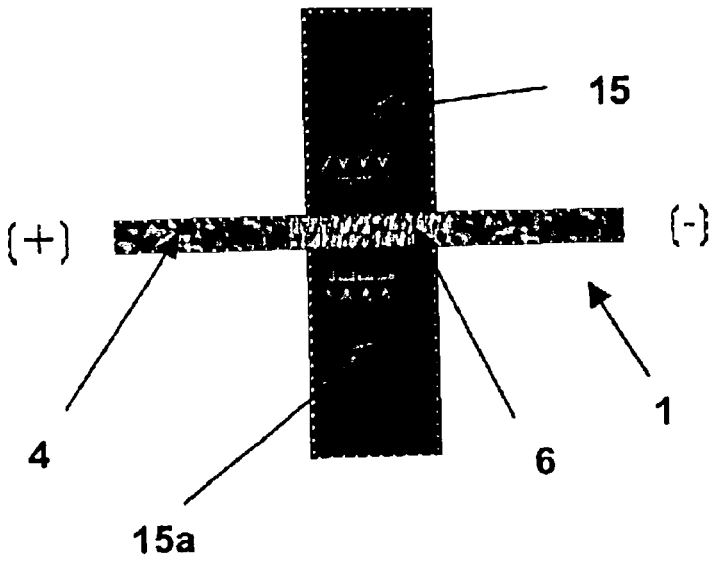
FIG. 8 is a schematic illustration from FIG. 7 during the electric resistance heating.

In FIG. 8, a voltage has been applied to the blank 1. The electric current flows through the blank and heats it to the left and right of the ceramic cylinder 15, 15*a* to the austenitization temperature 4. Since the ceramic cylinders 15, 15*a* at last partly take up the heat which arises from the electric resistance heating, as indicated by the arrows, the blank 12 between the ceramic cylinders 15, 15*b* remains below the austenitization temperature 6 in spite of the electric current passage.

Figure 9:
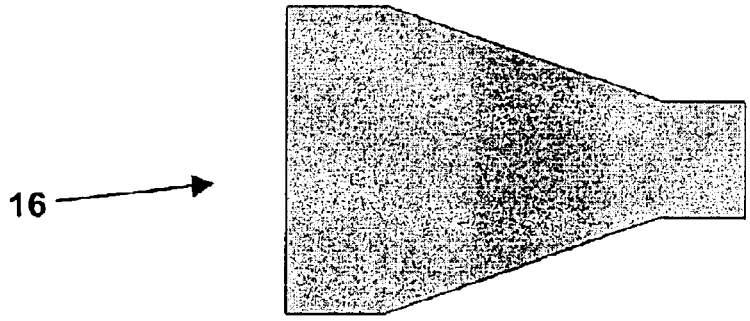
FIG. 9 is a diagrammatic plan view of a blank of nonuniform cross section over its length.

FIG. 9 shows schematically a blank 16 with a cross section which is not uniform over its length.

Figure 10:
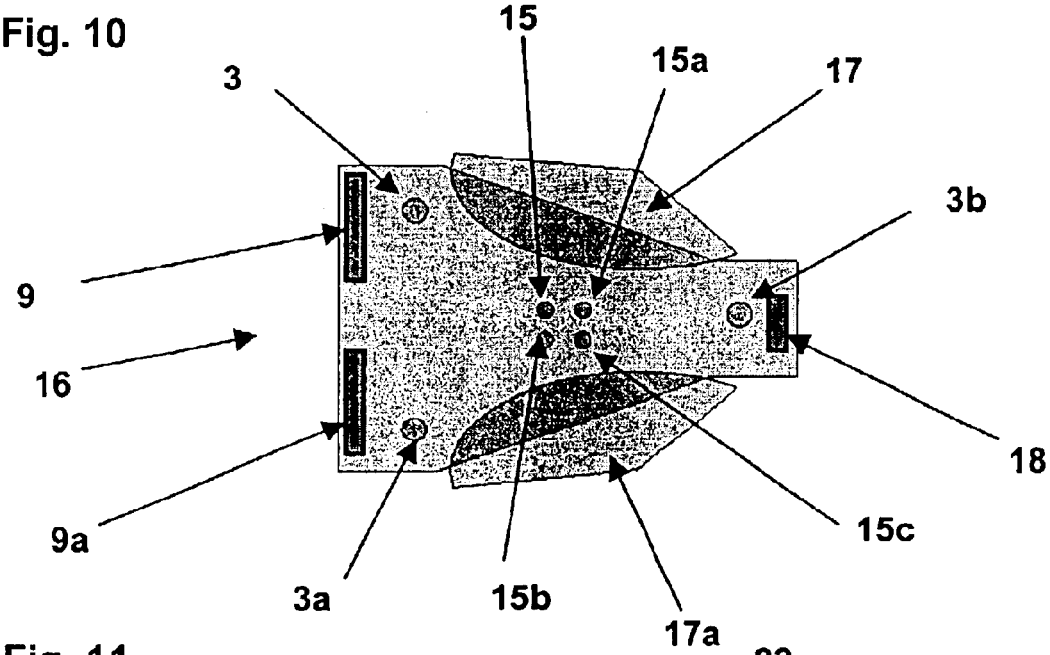
FIG. 10 is a view similar to FIG. 9 of the blank of FIG. 9 with three electrodes for heating and different bridging elements.

FIG. 10 shows the blank 16 of FIG. 9. At the broader end of the blank 16 there are two electrodes 9, 9*a* and at the smaller end one electrode 18 respectively on the upper side and the underside of the blank 16 for electric resistance heating. The lateral regions of the blank 16 are covered with respective poorly electrically conducting solid bodies 17, 17*a* like for example ceramic plates with relatively large areas. In the middle of the blank 16 are found four circular poorly electrically conducting solid bodies 15, 15*a*, 15*b*, 15*c* like for example four ceramic cylinders each of which covers only a relatively small region of the blank 16. At the broader end of the blank 16, respectively at the side regions and at the middle of the small end of the blank 16 there are respective electrically conducting solid bodies 3, 3*a*, 3*b* like for example copper cylinders. Upon an electric resistance heating of the blank 16 the electric current flows from the two electrodes 9, 9*a* at the broader end of the blank to the electrode 18 at the smaller end of the blank. The electric current thus heats all regions of the blank 16 apart from those covered with the solid bodies 3, 3*a*, 3*b*, 15, 15*a*, 15*b*, 15*c*, 17, 17*a*. The electrically conducting solid bodies which have been applied 3, 3*a*, 3*b* bridge the regions in which they are found at least electrically and in the case of copper cylinders, also thermally. The poorly conducting solid bodies 15, 15*a*, 15*b*, 15*c*, 17, 17*a* of for example ceramic, bridge the blank 16 in the first instance purely thermally in that they take up heat from the blank 16 so that the blank in these regions remains below the hardening temperature.

Figure 11:
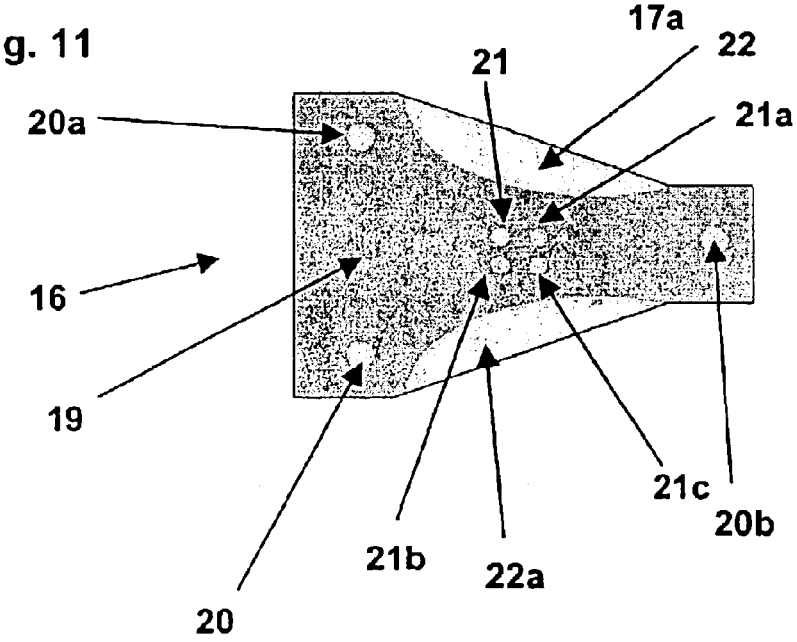
FIG. 11 is a view of the blank of FIG. 9 after a heating with hardened and unhardened regions.

FIG. 11 shows schematically the blank 16 after heating and subsequent cooling for the purpose of hardening. The hardened regions 19 of the blank 16 have been emphasized in dark grey. Where the solid bodies 3, 3*a*, 3*b*, 15, 15*a*, 15*b*, 15*c*, 17, 17*a* were found, there remain unhardened regions 20, 20*a*, 20*b*, 21, 21*a*, 21*b*, 21*c*, 22, 22*a* of greater ductility. The blank is thereby characterized by relatively small regions of higher ductility 20, 20*a*, 20*b*, 21, 21*a*, 21*b*, 21*c* in the center and at the respective ends of the blank, especially for subsequent machining like for example drilling or stamping. The relatively large regions of higher ductility 22, 22*a* at the lateral regions of the blank 16 can remain in the component for structural reasons, for example to take up deformation energy in case of a crash.

With the method according to the invention, therefore, in a simple, rapid and precise processing, a metallic component can be fabricated with regions of different ductility whereby the process can be integrated readily into an already existing hot shaping process.

What is claimed is:

1. A method of making a metal article having regions of greater and lesser hardness, comprising the step of:

(a) electrically resistance heating a hardenable steel blank by passing an electric current through said blank between conductors connected to said blank to a temperature sufficient to enable hardening of the steel of said blank and during said resistance heating selectively applying to at least one selected region of said blank a thermally conductive body to hold a temperature at said selected region below a temperature sufficient to enable hardening of the metal of said blanks; and (b) quenching said blank to produce an article hardened where said blank was heated to said temperature sufficient to enable hardening of the metal of said blank and ductile at said selected region.

2. The method defined in claim 1 wherein during the resistance heating of said blank only selected regions of said blank are resistively heated while other regions of said blank are not heated resistively and never reach said temperature sufficient to enable hardening of the metal of said blank.

3. The method defined in claim 1 wherein said thermally conductive body is an electrically conducting body of greater electrical conductivity than said blank to shunt electric current past said selected region thereby leaving said selected region at a temperature below said temperature sufficient to enable hardening of the metal of said blank.

4. The method defined in claim 1 wherein a cooling fluid is directed at said blank in said selected region to maintain a temperature in said selected region below said temperature sufficient to enable hardening of the metal of said blank.

5. The method defined in claim 1 wherein said resistance heating is effected by applying said electrodes to said blank in a predetermined pattern and passing electrical currents through said blank between selected ones of said electrodes for selectively heating said blank.

6. The method defined in claim 1 wherein jets of cooling liquid or gas from respective nozzles are directed against said blank for selected cooling thereof.

7. The method defined in claim 1 wherein said blank is cooled in a hot forming tool.

8. The method defined in claim 1, further comprising the step of machining the selected region.

9. The method defined in claim 8 wherein said selected region is drilled.

* * * * *